US008373555B1

(12) United States Patent
Redden et al.

(10) Patent No.: US 8,373,555 B1
(45) Date of Patent: Feb. 12, 2013

(54) GARAGE DOOR REMOTE SYSTEM WITH ALERT FEATURE

(76) Inventors: Clifford A. Redden, Indianapolis, IN (US); Memphis Yin, Tomball, TX (US); Phillip Haralson, Laguna Niguel, CA (US)

( * ) Notice: Subject to any disclaimer, the term of this patent is extended or adjusted under 35 U.S.C. 154(b) by 289 days.

(21) Appl. No.: 12/751,892

(22) Filed: Mar. 31, 2010

Related U.S. Application Data

(60) Provisional application No. 61/166,663, filed on Apr. 3, 2009.

(51) Int. Cl.
*G08B 1/08* (2006.01)

(52) U.S. Cl. ..... 340/539.1; 340/815.48; 340/5.71; 340/686.1

(58) Field of Classification Search ..... 340/5.71, 340/686.1, 815.48, 539.1
See application file for complete search history.

(56) References Cited

U.S. PATENT DOCUMENTS

| | | | | |
|---|---|---|---|---|
| 5,402,105 | A | 3/1995 | Doyle et al. | |
| 5,689,236 | A | 11/1997 | Kister | |
| 5,798,681 | A | 8/1998 | Chang | |
| 5,883,579 | A | 3/1999 | Schreiner et al. | |
| 6,070,361 | A | 6/2000 | Paterno | |
| 6,160,319 | A | 12/2000 | Marougi et al. | |
| 6,184,787 | B1 * | 2/2001 | Morris | 340/521 |
| 6,377,173 | B1 | 4/2002 | Desai | |
| 6,597,291 | B2 * | 7/2003 | Tsui | 340/686.1 |
| D490,380 | S | 5/2004 | Coullahan et al. | |
| 6,989,760 | B2 | 1/2006 | Dierking et al. | |
| 7,215,238 | B2 | 5/2007 | Buck et al. | |
| 2006/0220834 | A1 * | 10/2006 | Maeng | 340/539.1 |
| 2010/0081375 | A1 * | 4/2010 | Rosenblatt et al. | 455/41.1 |

OTHER PUBLICATIONS www.smarthome.com; autocloser; as of Mar. 31, 2010; internet.

* cited by examiner

*Primary Examiner* — George Bugg
*Assistant Examiner* — Sharmin Akhter

(57) ABSTRACT

A garage door opening system for alerting a user if the garage door is left open featuring an interface unit for integrating into the garage door, the interface unit comprises a motor microprocessor, a door position sensor; and an interface transceiver; and a remote device comprising a remote microprocessor, a remote transceiver, a speaker, and a push button, wherein the push button functions to move the garage door between the open and closed positions, wherein the transceivers are in two-way communication with each other within a range, wherein if the remote device is out of range and the garage door is left open the alarm is activated to alert the user.

12 Claims, 10 Drawing Sheets

GARAGE DOOR REMOTE SYSTEM WITH ALERT FEATURE

CROSS REFERENCE

This application claims priority to U.S. provisional application Ser. No. 61/166,663 filed Apr. 3, 2009, the specification of which is incorporated herein by reference in its entirety.

FIELD OF THE INVENTION

The present invention is directed to garage door systems related to opening and closing garage doors, more particularly to a garage door system that can indicate to a user (e.g., remotely) that a garage door is in an open position or a closed position.

BACKGROUND OF THE INVENTION

Electronic garage door opening systems are a standard feature in many homes. However, it is common for an individual to forget whether or not he/she has closed the garage door after leaving his/her house. The present invention features a garage door opening system comprising an alert feature for indicating to a user via a remote device if the garage door has been left in the open position. The system also allows for opening and closing of the garage door via the remove device. The remote device also comprises an interface that displays the status of the garage door.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-11, the present invention features a garage door opening system 100 comprising an alert feature. The alert feature can indicate to a user via a remote device if the garage door has been let in the open position when the remote device is more than a predetermined distance away from the garage door. The system also allows for opening and closing of the garage door via the remove device. The remote device also displays the status of the garage door (e.g., the remote device can communicate with components of the garage door, e.g., via a two-way RF link).

Garage Door Controller

In some embodiments, the system 100 of the present invention comprises a garage door controller operatively connected to the garage door. Garage door controllers are well known to one of ordinary skill in the art. For example, the garage door controller comprises a motor unit for moving the garage door between an open position and a closed position. The garage door controller may be an existing garage door controller, for example the system 100 is adapted to the existing garage door controller.

Figure 1:
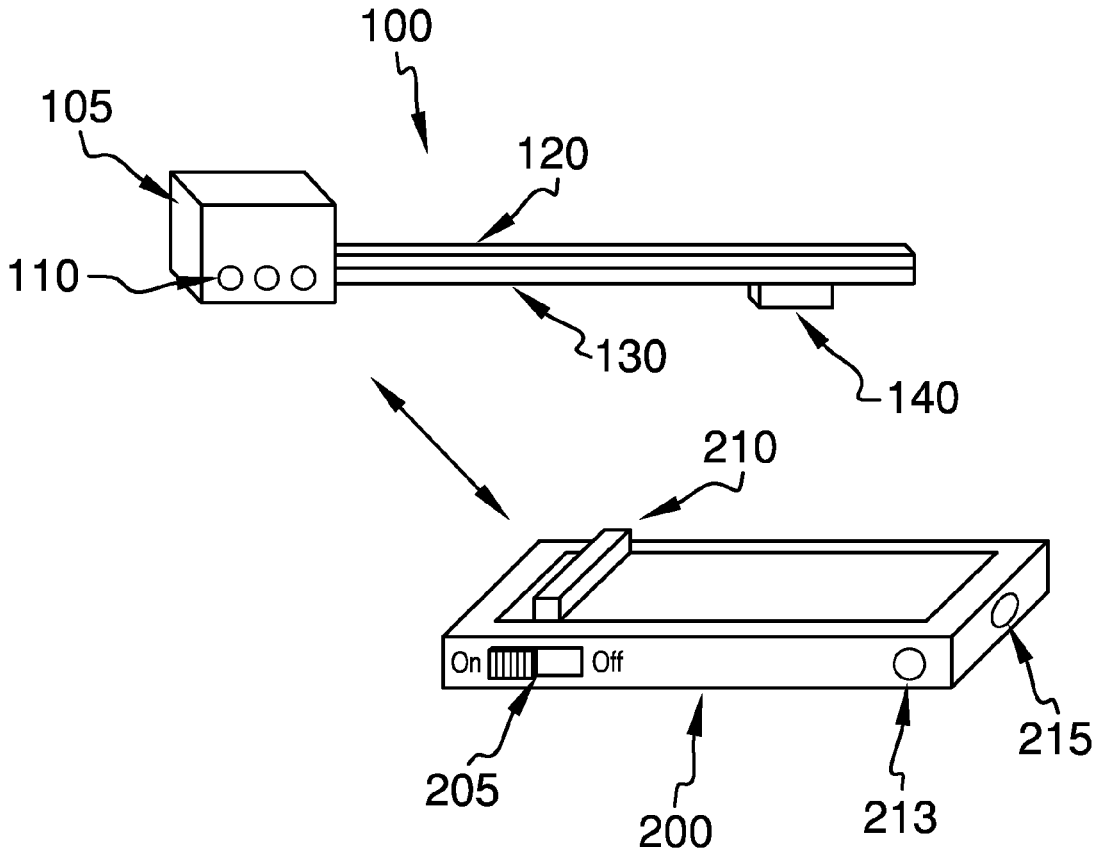
FIG. 1 is a perspective view of an example of a garage door controller and a remote device of the system of the present invention.

FIG. 1 shows an example of a garage door controller 100 responsible for opening and closing the garage door (and receiving various inputs). The garage door controller 100 comprises a garage door opener body 105 (housing the motor unit and controller and/or various electronics). The motor drives either a screw or a chain 130, which is attached to a cart 140 that slides on a rail 120. The cart 140 is attached to the garage door. As the screw is rotated or the chain 130 is moved, the cart 140 pushes or pulls the garage door open or closed. The garage door controller may further comprise adjustment knobs 110 for adjusting various operational parameters including but not limited to the signal strength of the wireless signal, the gain on an outgoing signal for a two-way communication, sensor parameters (e.g., force required to automatically reverse the garage door). The present invention is not limited to the aforementioned example of the garage door controller.

Figure 2:
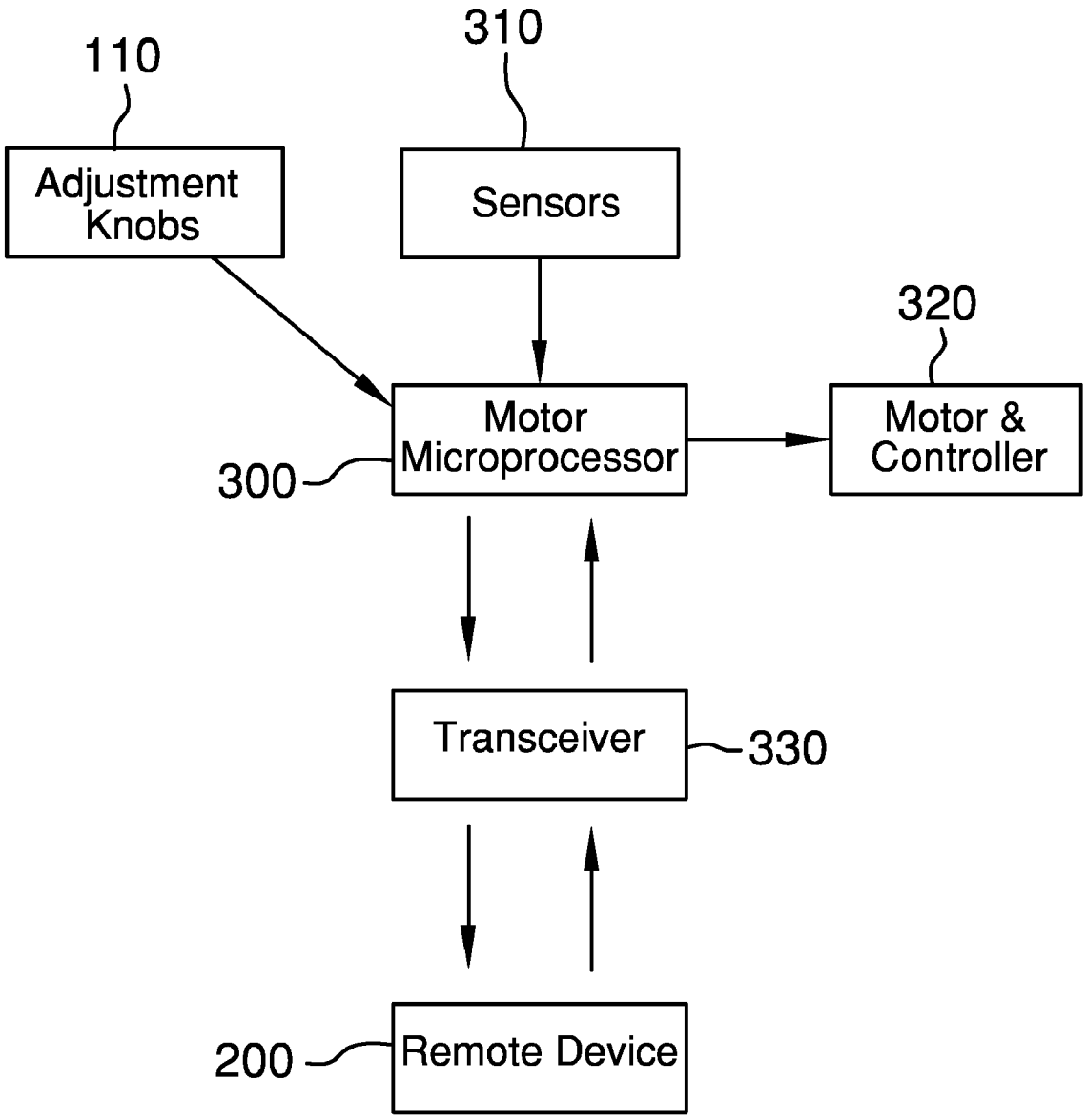
FIG. 2 is a schematic representation of components of the system of the present invention including a remote device in communication with an interface transceiver operatively connected to a motor microprocessor of the garage door controller.
Figure 3:
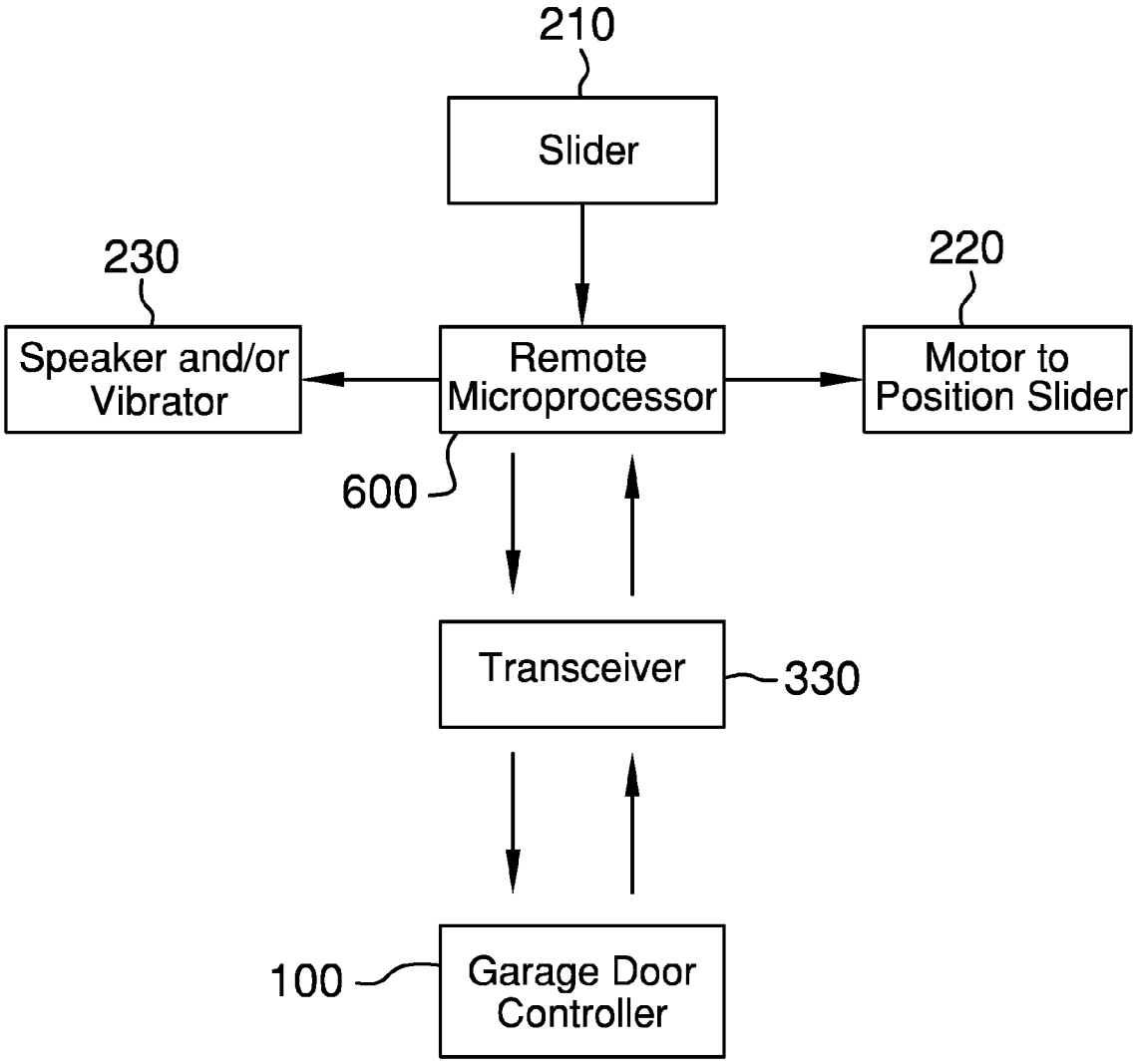
FIG. 3 is a schematic representation of the components of the system of the present invention including a remote microprocessor in the remote device in communication with the interface transceiver (e.g., via a remote transceiver).

Referring now to FIG. 2, the system 100 of the present invention further comprises a motor microprocessor 300 (e.g., microcontroller, e.g., low power microcontroller) operatively connected to the motor unit (and controller) 320, which manipulate the garage door as stated above. In some embodiments, the adjustment knobs 110 are operatively connected to the motor microprocessor 300 (e.g., microcontroller). In some embodiments, one or more sensors 310 (e.g., providing feedback control) are operatively connected to the motor microprocessor 300 (e.g., microcontroller). The sensors 310 may include but are not limited to a sensor (e.g., IR detector) for determining when there is an object in the way of the garage door, and a sensor for determining when the garage door has hit an object. The motor microprocessor 300 (e.g., microcontroller) is responsible for controlling the garage door. For example, the motor microprocessor 300 (e.g., microcontroller) provides output commands to the motor unit 320 (and controller), which functions to physically move the garage door. The motor microprocessor 300 (e.g., microcontroller) has the ability to stop the motor unit 320 (and controller) and run the motor unit 320 (and controller) in either direction.

Figure 10:
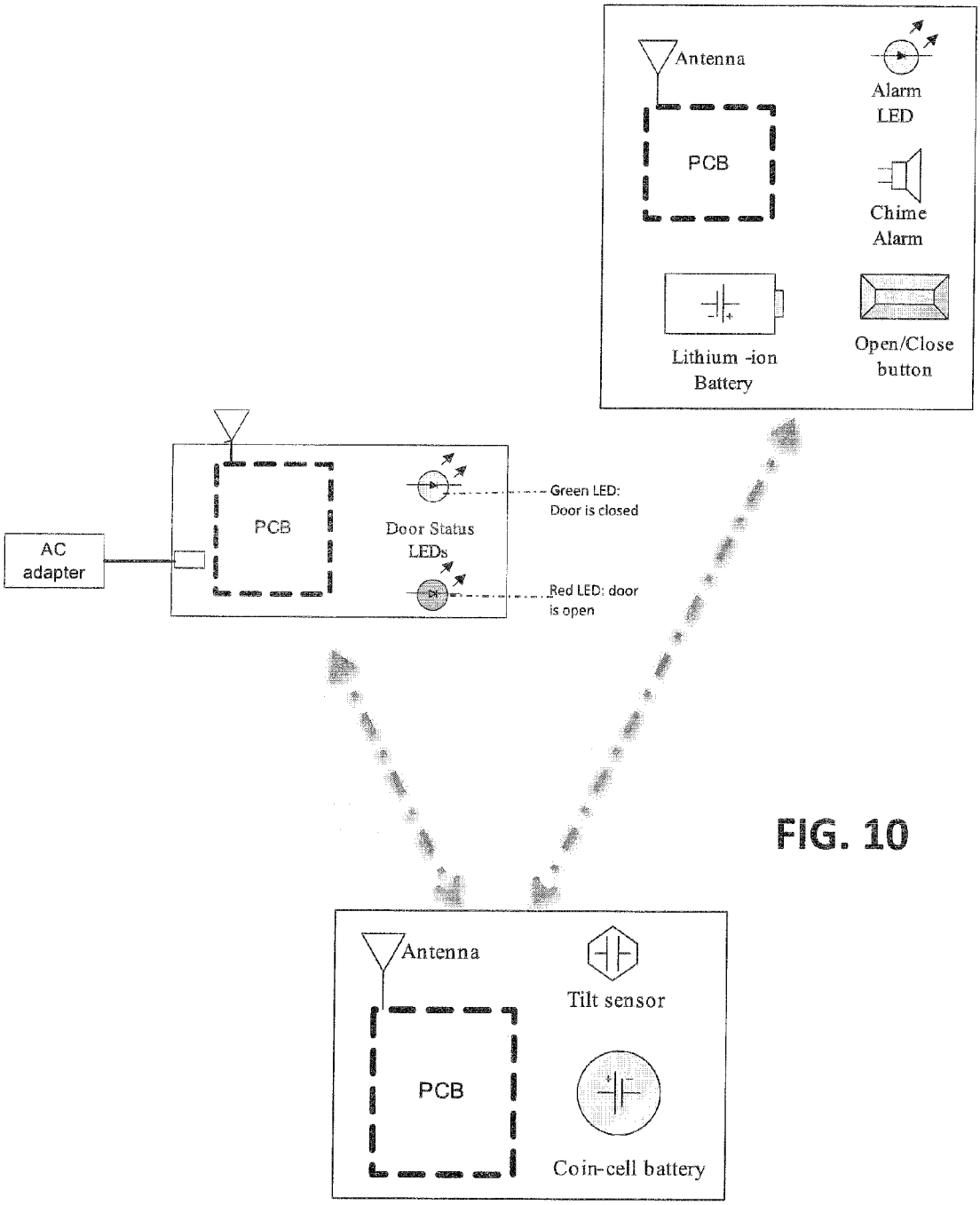
FIG. 10 is a schematic overview of the system of the present invention.
Figure 11:
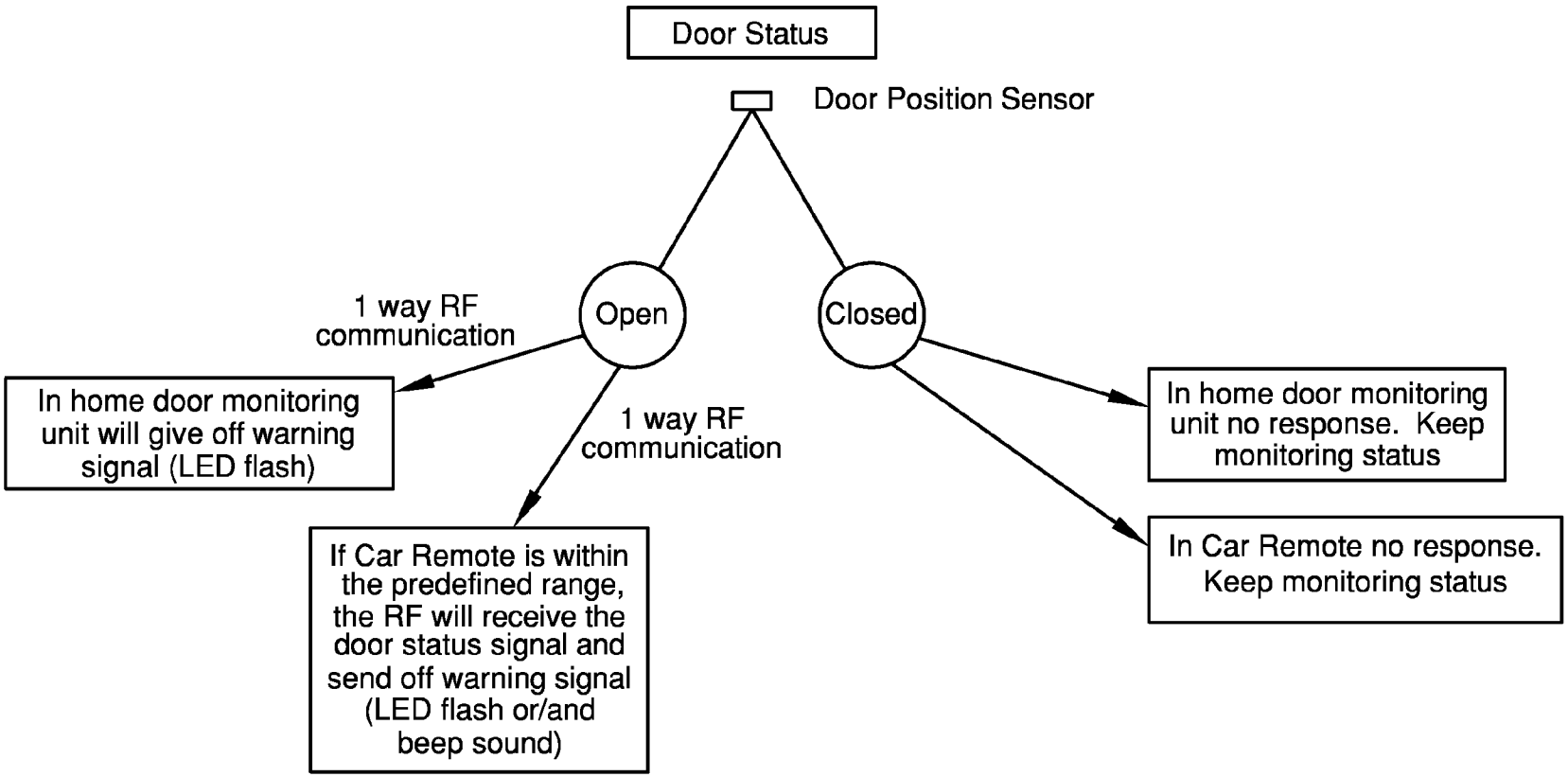
FIG. 11 is a schematic overview of the system of the present invention.

Referring now to FIG. 10 and FIG. 11, the garage door controller may feature a door monitor (e.g., "in home door monitor") with indicator lights for indicating the status of the garage door (e.g., a first light illuminated if the door is closed, a second light illuminated if the door is open). In some embodiments, a door position sensor (e.g., a tilt sensor) detects the status of the door. The door position sensor (e.g., tilt sensor) may be operatively connected to the motor microprocessor (and interface transceiver).

Transceiver/Interface Unit

Figure 5:
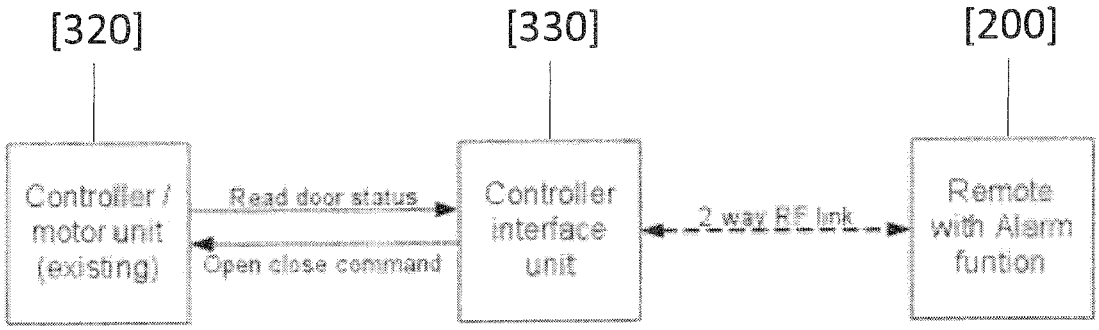
FIG. 5 is a schematic overview of the system of the present invention comprising a garage door controller (e.g., controller/motor unit), an interface unit with an interface transceiver (e.g., controller interface unit), and a remote device (e.g., remote with alarm function).
Figure 6:
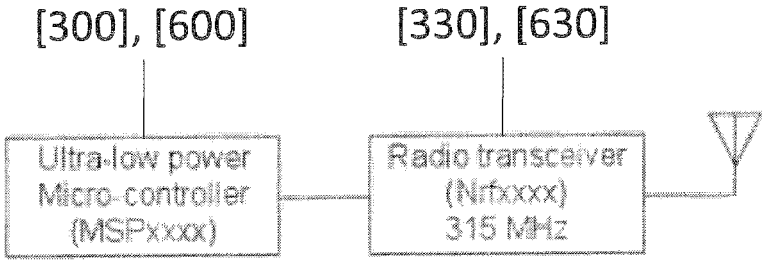
FIG. 6 is a schematic overview of the microprocessors (e.g., low power microcontrollers) comprising integrated transceivers (e.g., radio transceivers); the microprocessors may be operatively connected to the transceivers (e.g., separate discreet units).

The system 100 further comprises an interface unit with an interface transceiver 330 (e.g., RF transceiver) (or radio) for handling the wireless communications of the system 100. The interface transceiver 330 of the present invention replaces the standard RF receiver in standard garage door openers. For example, standard garage door openers generally have a receiver for receiving commands from remote wireless modules that can control the operation of the motor. This interface transceiver 330 of the present invention is adapted to send and receive data to the remote device 200 of the present invention, thus is capable of two-way communication with the remote device 200. This two-way communication allows the remote device 200 of the present invention to know the real-time status of the garage door (e.g., up or down). FIG. 5 shows a schematic representation of the system 100 of the present invention, wherein the remote device 200 is in two-way communication with the interface transceiver 330 ("controller interface unit"), which is operatively connected to the motor unit 320 (and controller) of the garage door (e.g., existing garage door). The interface transceiver 330 can send commands to the garage door to open and close the garage door and can also receive input signals indicating the real-time status of the garage door.

The interface transceiver 330 may be operatively connected to the motor microprocessor 300 (e.g., microcontroller, e.g., low power microcontroller). In some embodiments, the interface unit (interface transceiver 330, motor microprocessor 300) is installed next to the garage door controller (e.g., a motor unit of the garage door controller). The interface unit may comprise (a) open/close control lines; and (b) a door status inquiry interface.

Remote Device

Figure 4:
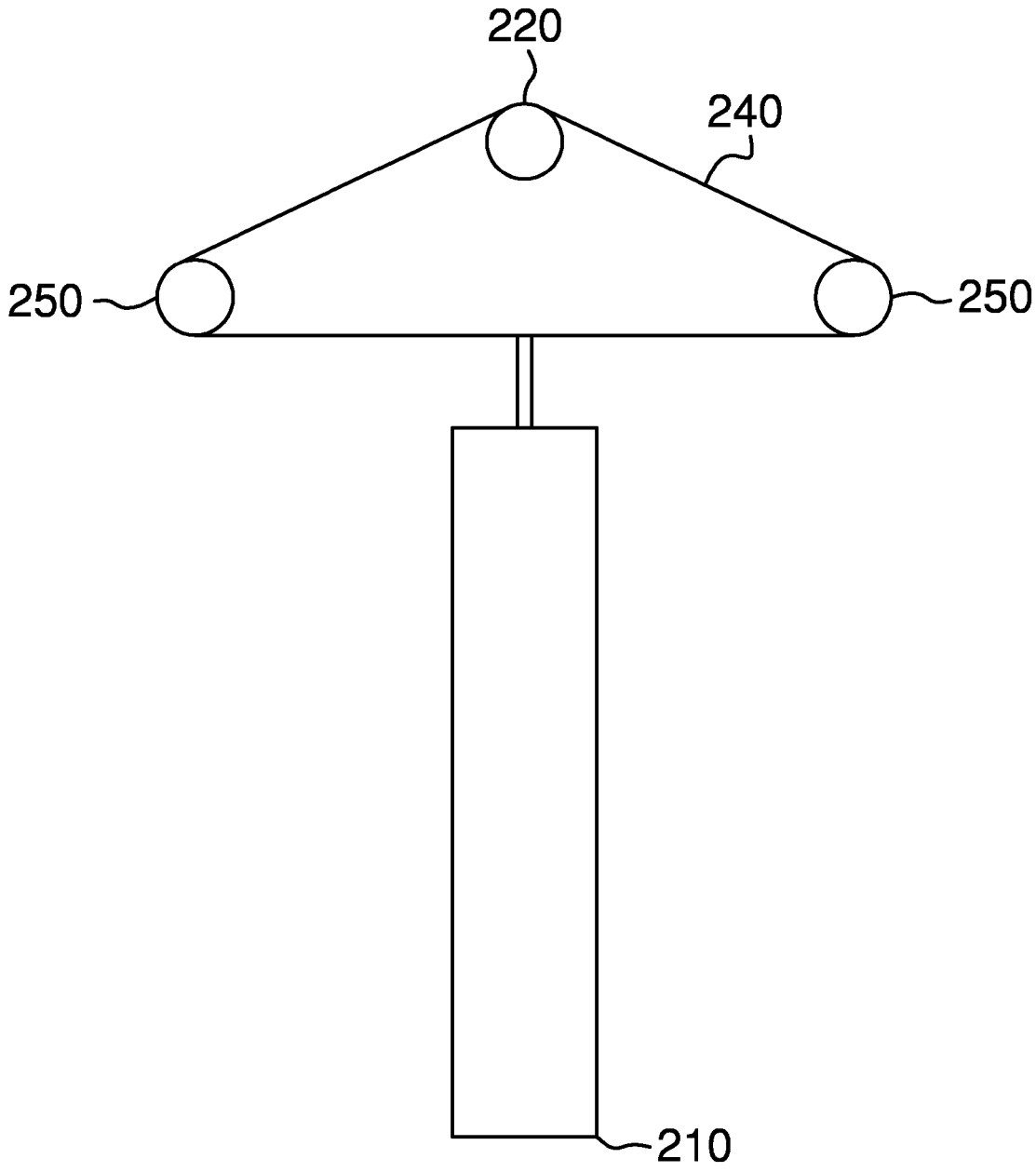
FIG. 4 is a schematic representation of the slider, internal motor, belt, and pulley of the remote device of the system of the present invention.
Figure 7:
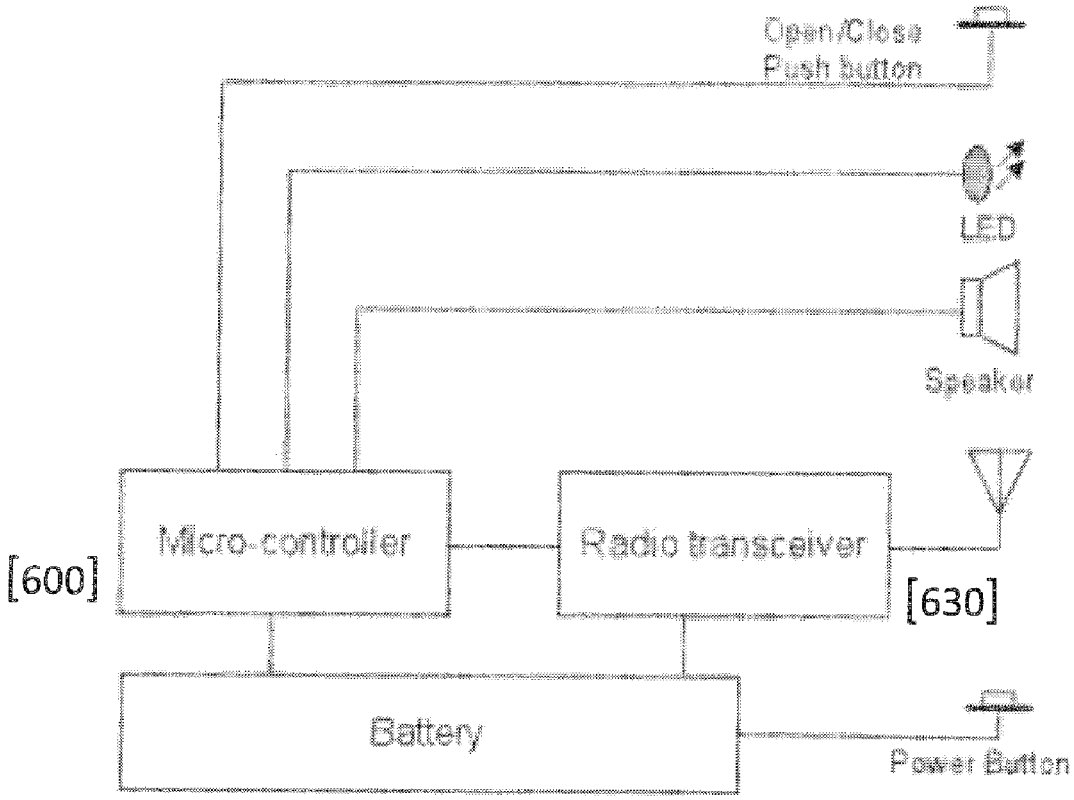
FIG. 7 is a schematic representation of the remote device of the system of the present invention comprising a remote microprocessor 600, a remote transceiver 630, a battery, a power button, a speaker, a light, and a push button for opening and closing the garage door. The remote device is not limited to this configuration or these components.

The system 100 of the present invention further comprises a remote device 200, which functions to send commands to and receive input from the transceiver 330. Generally, the remote device 200 is used inside a vehicle. The remote device 200 both manipulates the garage door (e.g., moving the garage door between the open position and the closed position) and indicates the real-time status of the garage door. FIG. 1, FIG. 4, and FIG. 7 show examples of remote devices 200 of the system 100 of the present invention, however the present invention is not limited to these configurations. Disposed inside the remote device 200 are a remote microprocessor 600 (e.g., microcontroller, e.g., low power microcontroller) and a remote transceiver 630. The remote transceiver 630 and the interface transceiver 330 are in communication with each other and are configured to communicate with each other within a range (e.g. predetermined distance).

The remote device 200 further comprises a speaker 230 (or vibrator) adapted to emit an alarm sound, which provides a means of alerting a user if the garage door is left open (and the remote device 200 is farther than a predetermined distance from the garage door). The speaker 230 is operatively connected to the remote microprocessor 600. The remote device 200 further comprises an indicator system for indicating the status of the garage door. In some embodiments, the indicator system is a light or series of lights (e.g., "LED" in FIG. 7). In some embodiments, the indicator system is a slider 210 slidably disposed on the remote device 200. In some embodiments, the indicator system is an electronic display disposed on the remote device 200. In some embodiments, for example if the indicator system is a light system, the light is illuminated if the garage door is in the open position and the light is not illuminated if the garage door is in the closed position. The present invention is not limited to the aforementioned indicator systems.

In some embodiments, a push button is disposed on the remote device 200 and operatively connected to the remote microprocessor. The push button functions to control the movement of the garage door. The push button can move between a first position to move the garage door to the closed position and a second position to move the garage door to the open position.

If a slider is used as the indicator system, the slider 210 may be used to both indicate the status of the garage door and to manipulate the garage door. The slider 210 may slide between a first position and a second position (and optionally a center position). In some embodiments, the slider 210 is operatively connected to an internal motor 220, which functions to move the slider 210 between the various positions. Generally, the position of the slider 210 reflects the real-time status of the garage door. For example, when the slider 210 is moved to the first position, the garage door is moved to the closed position. When the slider 210 is moved to the second position, the garage door is moved to the open position. In some embodiments, when the garage door is moved to the closed position, the slider 210 is moved to the first position and when the garage door is moved to the open position, the slider 210 is moved to the second position. Referring now to FIG. 4, the internal motor 220 drives a belt 240 (about a pulley system 250), which is fixed to the slider 210. The slider 210 and the internal motor 220 are operatively connected to the remote microprocessor 600.

In some embodiments, when the push button or slider 210 is moved to the first position, the push button or slider 210 sends a first button input signal to the remote microprocessor 600. Upon receipt of the first button input signal, the remote microprocessor 600 sends a first remote transceiver output command to the remote transceiver 630 to cause the remote transceiver to send a first door signal to the interface transceiver 330. Upon receipt of the first door signal, the interface transceiver 330 sends a first motor microprocessor signal to the motor microprocessor 300 whereupon the motor microprocessor 300 sends a first motor output command to the motor unit (and controller) to move the garage door to the closed position.

In some embodiments, when the push button or slider 210 is moved to the second position, the push button or slider 210 sends a second button input signal to the remote microprocessor 600. Upon receipt of the second button input signal, the remote microprocessor 600 sends a second remote transceiver output command to the remote transceiver 630 to cause the remote transceiver to send a second door signal to the interface transceiver 330. Upon receipt of the second door signal, the interface transceiver 330 sends a second motor microprocessor signal to the motor microprocessor 300 whereupon the motor microprocessor 300 sends a second motor output command to the motor unit (and controller) to move the garage door to the open position.

In some embodiments, the remote device 200 comprises a power switch 205 for turning on and off the remote device 200. In some embodiments, the remote device 200 further comprises a light 215 (e.g., incandescent, halogen, light emitting diode, etc.) and a light switch 213.

In some embodiments, the remote device 200 stays in a lower power mode. Power may be obtained via a battery. In some embodiments, the interface unit (e.g., interface transceiver) stays in a lower power listening mode and wakes up only to handle requests from the remote transceiver (e.g., request for door status information, relay the open/close commands sent from the remote device). In some embodiments, an external antenna is used for the interface unit. The interface unit is operatively connected to a power source (e.g., a battery, an electrical outlet via an AC adaptor, etc.).

Alert Mechanism

The system 100 of the present invention alerts a user (e.g., via the speaker 230 emitting the alarm sound, via a vibration system, or a combination thereof) if he/she has left the garage door in the open position, for example after he/she has left the house (e.g., when the remote device 200 moves farther away than predetermined distance). The remote transceiver 630 and the interface transceiver 330 are in communication with each other and are configured to communicate with each other within a range (e.g. predetermined distance). When the remote transceiver fails to detect the interface transceiver 330 (e.g., because the remote device 200 has been moved outside of the range of the transceivers 330), the remote transceiver 630 sends a first alarm input signal to the remote microprocessor 600. Upon receipt of the first alarm input signal, the remote microprocessor 600 recalls the position of garage door (e.g., the position as the remote device left the range of the transceivers). If the garage door was in the open position when the remote device 200 when out of range, the remote microprocessor sends a first alarm output command to the speaker 230 to cause the speaker 230 to emit the alarm sound. The alarm sound alerts the user that the garage door is still in the open position. If the garage door was in the closed position when the remote device 200 when out of range, the remote microprocessor does not send an output command to the speaker 230.

The alarm may be emitted for a certain length of time (e.g., 5 seconds, 10 seconds, 20 seconds, etc.). In some embodiments, the alarm turns off automatically.

The present invention is not limited to a speaker 230 with alarm for alerting the user. For example, a vibration system may be used to alert the user. In some embodiments, the remote device 200 comprises a silence button for silencing the speaker with alarm or vibration system (e.g., either while it's going off, or to prevent it from going off, etc.).

In some embodiments, an indicator light may become illuminated to indicate to the user that the remote device 200 (remote transceiver) has lost communication with the garage door controller and interface unit (interface transceiver).

In some embodiments, signal strength (e.g., of the transceivers) may be modified so as to change the range (e.g., the distance allowed before the alarm sounds). In some embodiments, the signal strength can be adjusted by a control on the garage door controller. This adjusts the distance that the signal can be received by the remote and thus the distance before the alert sounds. This alarm in some embodiments could include either a spoken announcement or a buzzer/alarm sound.

In some embodiments, the range of the transceivers is between about 100 to 200 feet. In some embodiments, the range of the transceivers is between about 200 to 500 feet. In some embodiments, the range of the transceivers is between about 500 to 1000 feet. In some embodiments, the range of the transceivers is between about 1000 to 5000 feet. In some embodiments, the range of the transceivers is between about 5000 feet to 2 miles. In some embodiments, the range of the transceivers is between about 2 to 10 miles.

In some embodiments, this two-way communication mechanism can be accomplished using microprocessor (e.g., microcontrollers) with integrated transceivers or microprocessor (e.g., microcontrollers) with a separate transceiver. In some embodiments, the data format used for communication is developed by the designer, but would include at least, a unique device ID, and the state of the garage door.

In the case where there are multiple remote devices 200, there may be a case where the garage door becomes out of sync with the remote devices 200 (e.g., the push buttons, the sliders 210). To correct for this case, the remote microprocessor 600 and remote transceiver 630 may constantly be monitoring the position of the push button or slider 210 and the state of the garage door. When the remote microprocessor 600 finds that the push button or slider 210 is out of position, the internal motor 220 will in some form reposition the push button or slider 210. In the case of a slider 210, this may be accomplished via the belt 240 connected to the motor 220 and slider 210. In some embodiments, if the user tries to push the slider 210 while the motor is running, it will be allowed to slip. After the motor 220 positions the switch, it disengages so that the user can control the slider 210. This may be accomplished by ensuring that there is sufficient slack in the belt 240 to allow for it to slip on the motor 220. In some embodiments, the motor 220 can be allowed to freely rotate when not powered, or the tension in the belt 240 can physically be released by releasing some of the tension on a belt tensioner. If the user begins to press on the slider 210 before the slider is in the appropriate position, the motor 220 disengages and allows the user to control it.

Figure 8:
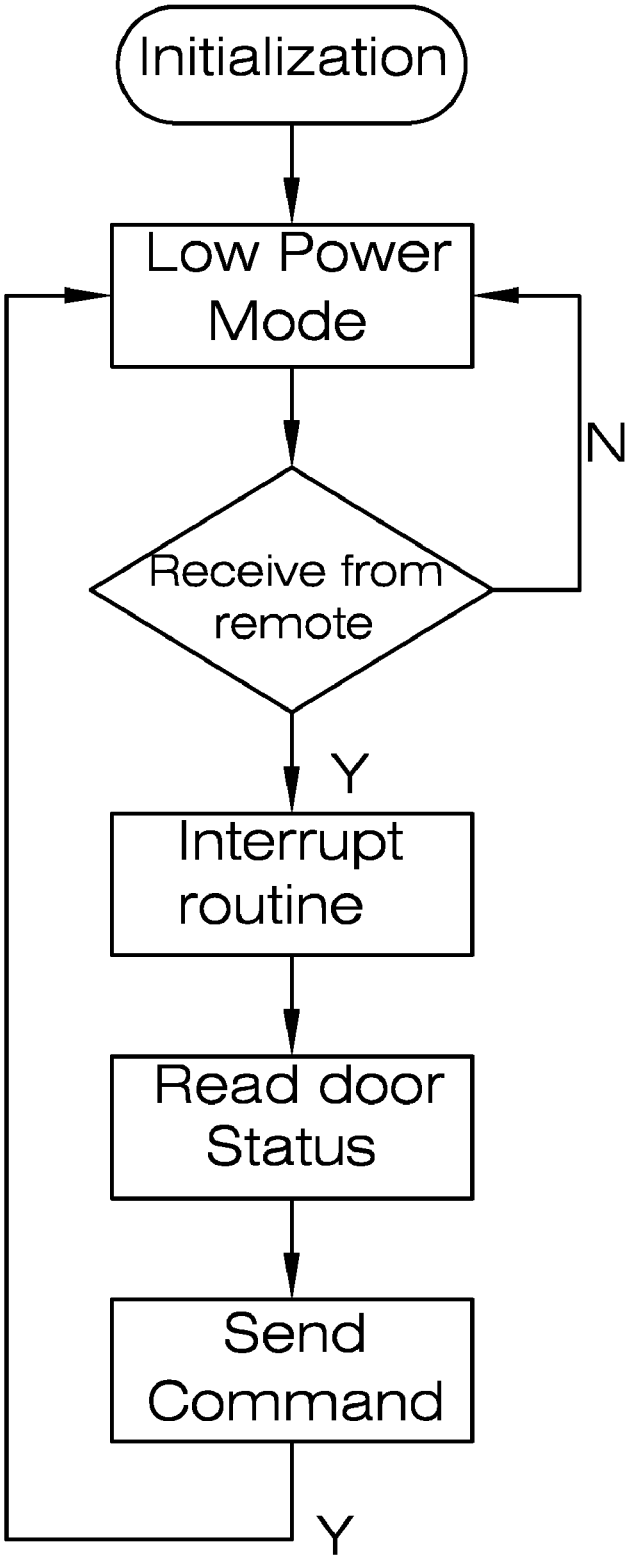
FIG. 8 is a schematic representation of an example of a software flow chart for the interface unit.
Figure 9:
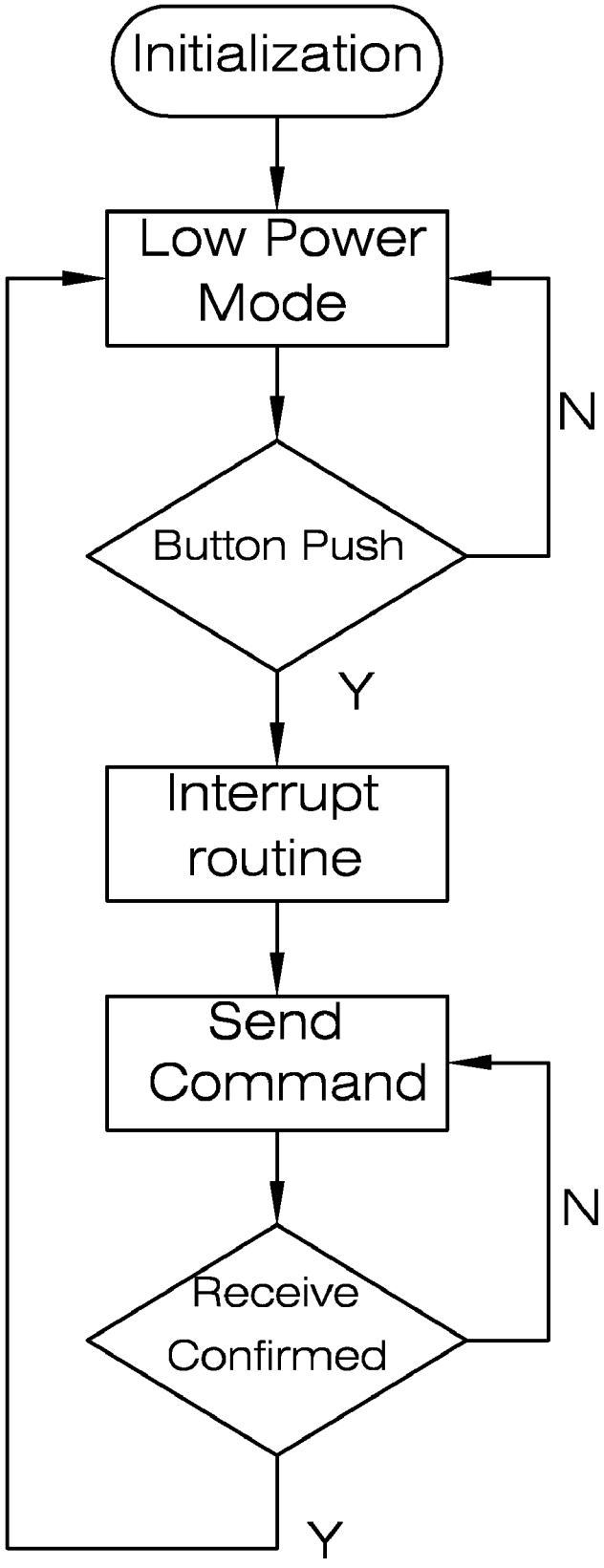
FIG. 9 is a schematic representation of an example of a software flow chart for the remote device.

In some embodiments, the transceivers operate in the 315 MHz ISM band, for example. Software may in some embodiments be developed in C language and be compiled for the microcontrollers (microprocessors) in both the interface unit and the remote device independently. Layered communication software architecture defined interface may ensure reliability. Error detection and retransmission in radio link layer ensures data integrity. FIG. 8 shows an example of a software flow chart for the interface unit, and FIG. 9 shows an example of a software flow chart for the remote device.

As used herein, the term "about" refers to plus or minus 10% of the referenced number. For example, an embodiment wherein the range of the transceivers is about 100 feet includes a range between 90 and 110 feet.

The following disclosures of the following U.S. Patents are incorporated in their entirety by reference herein: U.S. Pat. No. 7,215,238; U.S. Pat. No. 5,883,579; U.S. Pat. No. 5,798,681; U.S. Pat. No. 5,402,105; U.S. Pat. No. 6,989,760; U.S. Pat. No. 6,377,173; U.S. Pat. No. 5,689,236; U.S. Pat. No. 6,160,319; U.S. Pat. No. 6,070,361.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A garage door opening system comprising:

(a) an interface unit comprising:

(i) a motor microprocessor for operatively connecting to a standard motor unit of a standard garage door;

(ii) a door position sensor operatively connected to the motor microprocessor and to the standard motor unit of the standard garage door controller, the door position sensor functions to detect a position of the garage door, the position being either a closed position or an open position; and (iii) an interface transceiver operatively connected to each the motor microprocessor and the door position sensor; and (b) a remote device for manipulating the position of the garage door and for indicating the position of the garage door, the remote device comprising:

(i) a remote microprocessor;

(ii) a remote transceiver operatively connected to the remote microprocessor, the remote transceiver and the interface transceiver are in two-way communication with each other within a range, the interface transceiver functions to relay the position of the garage door to the remote transceiver and remote microprocessor, the remote transceiver functions to detect the interface transceiver within the range;

(iii) a speaker adapted to emit an alarm when activated, the speaker is operatively connected to the remote microprocessor; and (iv) an indicator system disposed on the remote device for visually indicating the position of the garage door, wherein the indicator system is operatively connected to the remote microprocessor, wherein the indicator system is a slider, wherein the slider is used to both indicate the position of the garage door and to manipulate the garage door, wherein the slider slides between a first position, a second position, and a center position, wherein the position of the slider reflects a real-time status of the garage door, wherein, when the slider is moved to the first position, the slider sends a first button input signal to the remote microprocessor, wherein upon receipt of the first button input signal, the remote microprocessor sends a first remote transceiver output command to the remote transceiver to cause the remote transceiver to send a first door signal to the interface transceiver, wherein upon receipt of the first door signal, the interface transceiver sends a first motor microprocessor signal to the motor microprocessor, whereupon the motor microprocessor sends a first motor output command to the motor unit (and controller) to move the garage door to the closed position, wherein, when the slider is moved to the second position, the slider sends a second button input signal to the remote microprocessor, wherein upon receipt of the second button input signal, the remote microprocessor sends a second remote transceiver output command to the remote transceiver to cause the remote transceiver to send a second door signal to the interface transceiver, wherein upon receipt of the second door signal, the interface transceiver sends a second motor microprocessor signal to the motor microprocessor, whereupon the motor microprocessor sends a second motor output command to the motor unit (and controller) to move the garage door to the open position.

2. The system of claim 1 further comprising a door monitor for housing the interface unit, the door monitor comprises indicator lights for indicating the position of the garage door.

3. The system of claim 1, wherein the interface transceiver is integrated into the motor microprocessor or the remote transceiver is integrated into the remote microprocessor.

4. The system of claim 1, wherein the range of the transceivers is between about 100 to 200 feet.

5. The system of claim 1, wherein the range of the transceivers is between about 200 to 500 feet.

6. The system of claim 1, wherein the range of the transceivers is between about 500 to 5000 feet.

7. The system of claim 1, wherein the range of the transceivers is between about 5000 feet to 10 miles.

8. The system of claim 1, wherein the indicator system comprises a light disposed on the remote device for visually indicating the position of the garage door, wherein the indicator system is operatively connected to the remote microprocessor, wherein the tight is illuminated if the garage door is in the open position.

9. The system of claim 1, wherein the remote device further comprises a light and a light switch.

10. The system of claim 1, wherein the speaker with alarm of the remote device is replaced with a vibration system.

11. The system of claim 1 comprising a vibration system in combination with the speaker with alarm of the remote device.

12. The system of claim 1, wherein the alarm is emitted for about 5 seconds, about 10 seconds, or about 20 seconds.

* * * * *